US005238113A

United States Patent [19]

Parrott et al.

[11] Patent Number: 5,238,113

[45] Date of Patent: Aug. 24, 1993

[54] COIL RETENTION, PROTECTION AND GUIDANCE DEVICE

[75] Inventors: David Parrott, Nashville, Tenn.; Robert Zempel, Downingtown, Pa.

[73] Assignee: Illinois Tool Works, Inc., Glenview, Ill.

[21] Appl. No.: 933,251

[22] Filed: Aug. 21, 1992

[51] Int. Cl.[5] ..... B65D 85/66

[52] U.S. Cl. ..... 206/395; 206/397; 206/401; 206/400

[58] Field of Search ..... 206/395, 396, 397, 398, 206/400, 401, 53, 408, 389

[56] References Cited

U.S. PATENT DOCUMENTS

| | | | |
|---|---|---|---|
| 1,927,403 | 9/1933 | Hoffmann | 206/397 |
| 2,217,397 | 10/1940 | Armitt | 206/395 |
| 2,278,037 | 3/1942 | McIntire | 206/396 |
| 3,982,712 | 9/1976 | Bassett | 206/395 X |
| 4,496,049 | 1/1985 | Pabodie et al. | 206/396 X |
| 4,513,864 | 4/1985 | Liebel | 206/396 |
| 4,840,274 | 6/1989 | Young | 206/400 X |

FOREIGN PATENT DOCUMENTS 324334 1/1930 United Kingdom .

*Primary Examiner*—Steven N. Meyers
*Assistant Examiner*—Jacob K. Ackun, Jr.
*Attorney, Agent, or Firm*—Schwartz & Weinrieb

[57] ABSTRACT

A coil retention, protection and guidance device, comprising a bow tie-shaped device scored at a pair of separate and parallel locations across its width and forming at its ends two rectangular members; perforated at a single location parallel to and equidistant from said scored locations across its width and through its midpoint forming two mirror-image trapezoid members between said scored locations; and conformed to embrace the outer layer of a coiled bundle generally radially and across the bundle's width. The device, when applied to a coil of strand material, protects the material during shipment and storage, and facilitates the unravelling of the strand.

18 Claims, 3 Drawing Sheets

COIL RETENTION, PROTECTION AND GUIDANCE DEVICE

FIELD OF THE INVENTION

The present invention relates to an apparatus for retaining, protecting and guiding, upon delivery, coiled products such as wire, cables, flexible tubing, ropes, plastic strapping materials, and the like, rolled into ring-shaped bundles on drums or reels more commonly referred to in the industry as a core. These materials are coiled into superposed layers, the number of which is upon the product's thickness and the desired size and weight of the resulting bundle. When the coil has achieved its proper dimension and weight, the strands must be secured to prevent slippage or unraveling known as "shelling."

BACKGROUND OF THE INVENTION

The conventional means for securing coiled products to the core involves tightening a strap, applying a piece of strong adhesive tape, or wrapping and tying a string or the like across the shaped bundle and through the center of the core at spaced intervals. These straps, upon tightening, frequently cause the portion of the coiled product which is exposed along the sides and around the perimeter of the bundle to become deformed or damaged, and may cause bending or cracking under pressure. Furthermore, during transport and storage, damage may occur if the bundle is positioned so that the straps are pressed against the sides of the bundle by a truck bed, warehouse floor or adjacent bundles in stacked configuration.

In the past, and as described in U.S. Pat. No. 4,840,274 to Young issued Jun. 20, 1989, flat pieces of paperboard or corrugated doughnut-shaped buffer means have been placed between the side portions of the bundles and the strap retainers in an effort to protect the outer layer of coiled product. While these doughnuts are capable of protecting the coiled product located along the sides of the bundle from damage, they do not possess the ability of protecting that portion of the coiled product located around the perimeter of the bundle because their circular design will not accommodate successful folding such that protection of these strands can be accomplished.

The bundles are then delivered to the distributer and ultimate users where they are placed onto a dispensing apparatus which delivers lengths of the coiled product suitable for its intended purpose. Dispensing apparatus usually comprise a shaft or rod onto which the core of the coiled bundle is rotatably-mounted for unraveling. Protective circular flanges are positioned so as to abut the coiled bundle at either side and in a substantially parallel relationship in an effort to stabilize the coil during unraveling.

Before such lengths of coiled product can be dispensed, however, the securing straps or ties must be cut. When this is done, the coil frequently loosens, becoming incapable of maintaining its shape and compacted integrity. All too often the strands become lodged in gaps between the flange and outer surface of the coil which retards or, in some instances, prevents dispensing of the strands. The gaps are caused by warping or bending of the flange portions of the dispensing unit during use. Strands are further permitted to become lodged when no guide means exists to adequately control the strand's lateral movement during unraveling.

Attempts have been made to avoid strands from lodging in gaps through the use of the corrugated doughnut-shaped buffer means described above. As stated, these doughnuts are secured to the bundle with retaining straps or strings, and ultimately are situated between the coil bundle and flanges so as to fill any gaps that may exist. The use of doughnuts are, however, undesirable, not only for their failure to protect the coiled product along the bundle's perimeter, but also because they impede visual inspection of the product during display and use. Furthermore, the doughnuts require the use of a greater amount of protective material than does the present invention, summarized below.

SUMMARY OF THE INVENTION

In general, the present invention provides a novel apparatus for retaining, protecting and guiding upon delivery coiled products such as wire, cables, flexible tubing, ropes, plastic strapping materials, and the like, which are rolled onto drums or reels more commonly referred to in the industry as a core. There is thus provided an apparatus in accordance with the present invention, a plurality of which are to be applied to a coiled bundle and secured to the same by conventional strapping or tying means.

More specifically, the present invention relates to a device comprising a novel bow tie-shaped retention, protection and guidance means made of corrugated fiberboard or other stiff material capable of being scored at a pair of separated locations such that when folded, it conforms to embrace the outer layer of a coiled bundle radially and across its width. The bow tie-shaped device is perforated across its middle and tangential to the core's axis of rotation such that, when torn, it permits the product strand to unravel as the core is caused to rotate. The portions of the bow tie which overlay the width of the coil guide the unraveling strand. The portion of the bow tie secured between the sides of the unraveling coil and the adjacent flange prevent the strand from becoming jammed between the side of the coil and the flange. The device's bow tie shape thus allows for free flow withdrawal of strand material without permitting lodging of the strand between the coil bundle and dispensing device, acting as a guide for the strand during dispensing.

OBJECTS OF THE INVENTION

It is thus, an object of the present invention to eliminate the deficiencies associated with the prior art as described above, and further relates to a device that not only acts to retain a coiled product about the core and to protect the coiled product during storage, shipment and use, but further acts to guide the strands during dispensing.

It is another object of the present invention to provide a coil retention, protection and guidance device capable of protecting not only the coiled product exposed at the sides of the bundle, but capable of protecting the coiled product around the perimeter of the coil as well.

It is yet another object of the present invention to provide a coil retention, protection and guidance device that acts as a buffer means between the coiled bundle and dispensing apparatus, such that the coiled product strand is prevented from becoming lodged in gaps resulting from misshaped flanges.

It is another object of the present invention to provide a coil retention, protection and guidance device that utilizes a minimum amount of material, and allows for visual inspection of the coiled product sale and dispensing.

Still a further object of the present invention is to provide a coil retention, protection and guidance device that is simple in design and use, economical to manufacture and easily produced by means of automated machinery.

BRIEF DESCRIPTION OF THE DRAWINGS

The present invention will be more fully understood and appreciated from the following detailed description taken in conjunction with the drawings, in which like reference characters designate like or corresponding parts throughout the several views, and where.

DETAILED DESCRIPTION OF THE PREFERRED EMBODIMENT

Figure 1:
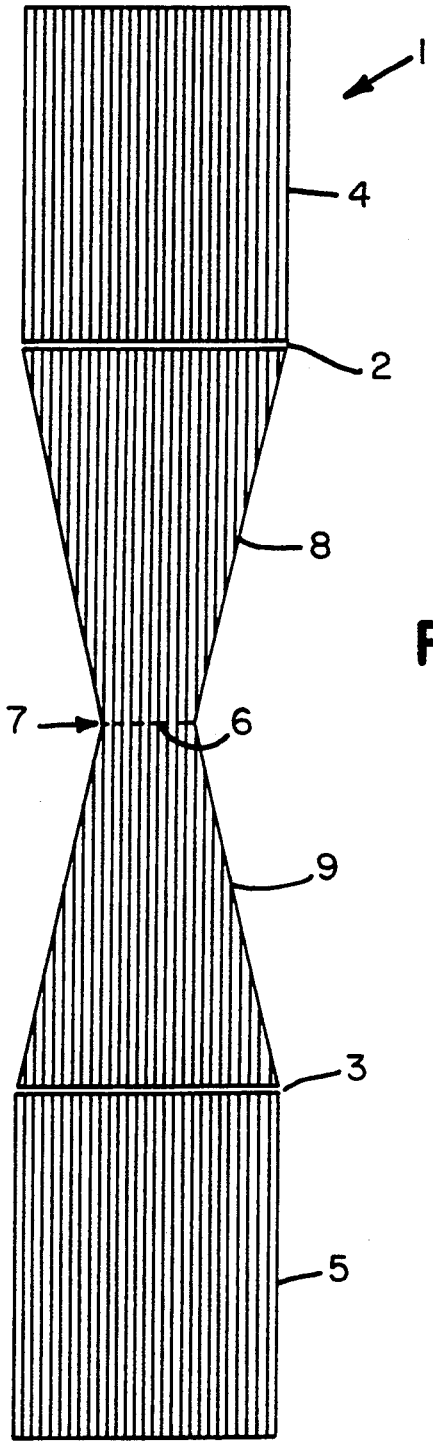
FIG. 1 is a plan view of the present invention.

Turning now to the drawings, and initially to FIG. 1, the preferred embodiment of the present invention 1 is shown having a bow tie shape. The bow tie is constructed of corrugated fiberboard or other rigid material capable of being scored at a pair of separated and parallel locations 2 and 3 across device 1's width facilitating the formation at its ends of rectangular members 4 and 5, respectively. Device 1 is also capable of being perforated at a single location 6 parallel to and equidistant from scored locations 2 and 3, across device 1's width and through its midpoint 7 such that two mirror-image trapezoid members 8 and 9 are formed between scored locations 2 and 3.

Figure 2:
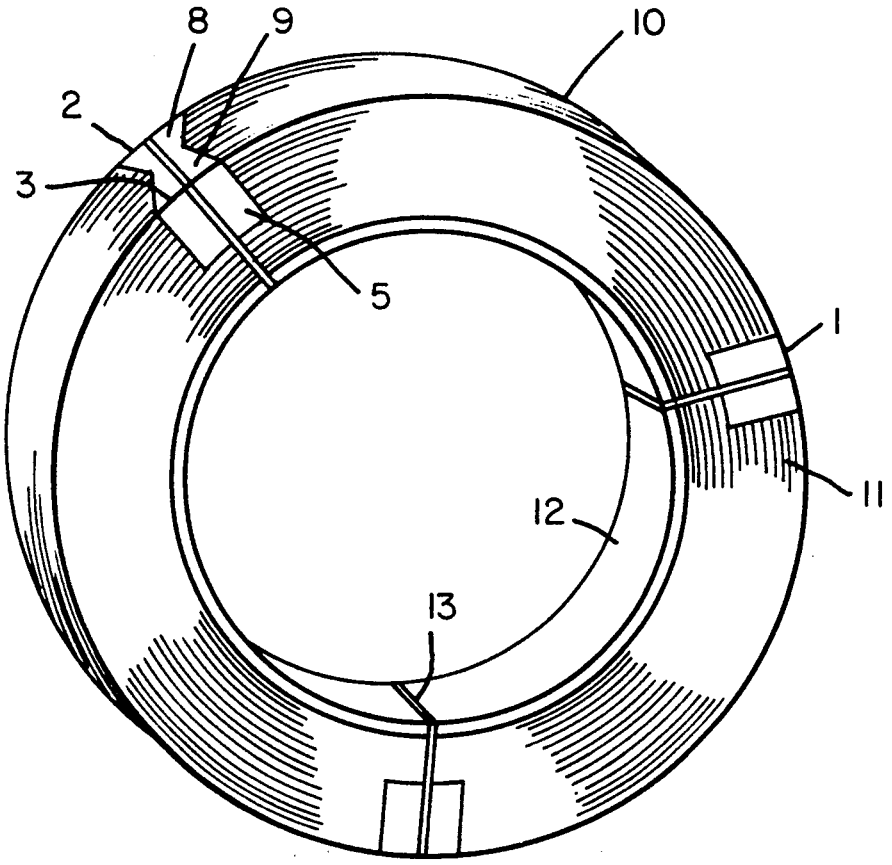
FIG. 2 is a perspective view of a plurality of devices of the present invention as they are applied to a coil of strand material.

Referring now to FIG. 2, a plurality of devices 1 of the present invention are shown as they are applied to a coil of strand material. As can be observed, a plurality of the present invention devices, at least two, are folded that is at 90 degree angles along scored locations 2 and 3, such that they conform to embrace the outer layers of a coiled bundle 10 generally radially and across the width of the coil. Coiled bundle 10 may consist of any strand product or material 11 such as wire, cable, flexible tubing, rope, plastic strapping materials, and the like, wound, rolled or coiled in superposed layers around a core 12 or similarly-shaped drum, reel or spool adapted for rotatable mounting onto a shaft or rod 14 (see FIGURES).

More specifically, a transverse side of bow tie device 1 serves to embrace the outer layers of coiled bundle 10 such that rectangle-shaped members 4 and 5 partially cover the exposed strand of product 11 situated on the sides of coiled bundle 10, and trapezoid members 8 and 9 cover the exposed strand product 11 situated around the perimeter of coiled bundle 10. This placement of each device 1 acts not only to retain coiled product 11 about core 12, but also acts to protect the coiled product along the bundle's periphery from damage during storage, shipment and use.

Conventionally, strand product 11 was secured to core 12 by a tightening strap 13, applying a piece of strong adhesive tape, or wrapping and tying a string or the like across the shaped bundle at spaced intervals. These straps frequently caused the outside layer of coiled product to become damaged or deformed when tightened. The present invention acts as a buffer means between such securing means and the outside layer of strand product 11, thus protecting the latter from damage by the former upon tightening. In addition, the present invention, when applied to coiled bundle 10, protects the exposed portions of the strand product 11 situated along the sides and around the perimeter of the bundle from damage due to impact with foreign bodies.

The wide shape of the present invention's rectangle members 4 and 5, and the trapezoid shape of members 8 and 9, combined with the device's rigid construction, provide an improved means for retaining the strand product 11 about core 12. It should be noted that the relative size and shape of rectangle members 4 and 5, as well as trapezoids 8 and 9, can be custom tailored to maximize protection or visibility of the embraced coils. Increased protection can be achieved by increasing the size or number of the devices used. Increased visibility of the underlying strand product 11 can be achieved by decreasing the size or the number of devices. A minimum of two devices should be utilized in the preferred application of the present invention.

Figure 3:
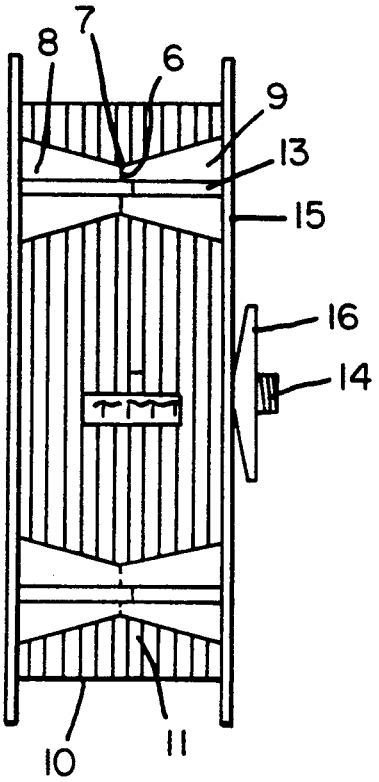
FIGS. 3 and 4 are elevation views of a plurality of devices of the present invention as they are applied to a coil of strand material mounted on dispensing apparatus, FIG. 3 being a frontal elevation view of be coil shown in FIG. 2 mounted on a dispensing apparatus before the end of the strand has been unsecured, FIG. 4 being a front elevation view of a coil shown in FIG. 2 mounted on the dispensing apparatus after the bow ties and securing straps have been severed and the end of the strand has been unsecured.
Figure 4:
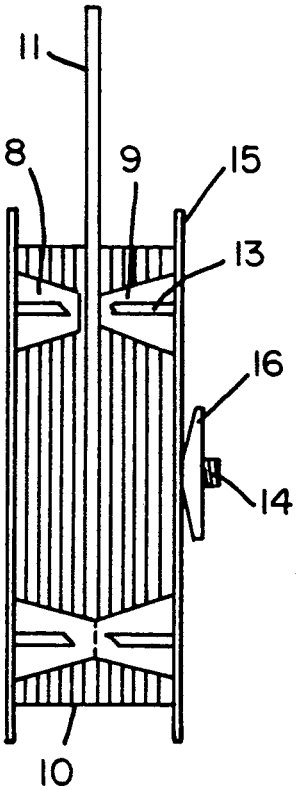

Referring now to FIGS. 3 and 4, the present invention can be seen as it is applied to a coil of strand material 11 which in turn is rotatably-mounted on a dispensing apparatus, comprising a shaft or rod 14 surrounded at either end by detachable circular flange members 15 secured by wing nut 16. Before lengths of strand material 11 can be dispensed, securing ties 13 must be cut. When this is done, the rigid construction of the embracing present invention reduces undesirable unraveling of the coiled bundle 10. Additionally, the presence of the rectangular members 4 and 5 of the present invention between coiled bundle 10 and flange members 15 prevents the formation of gaps in which strand material 11 can become lodged.

The bow tie-shaped device 1 is perforated at a location 6 across its middle, through its midpoint 7 and aligned with the circumference of the coiled bundle 10 such that the plurality of perforations 6 are disposed within a plane which is perpendicular to the axis of rotation of core 12 such that, when torn, it permits the product strand 11 to unravel as core 12 is rotated. The trapezoid members 8 and 9 forming the device's bow tie shape, together with its rigid construction, allow for free flow withdrawal of the strand product 11 without permitting the strand to jump laterally across flange members 15, thus acting as a guide for the strand during dispensing.

The bow tie shape facilitates the use of the core after it is mounted on a dispenser. When the free end of the strand is pulled, causing the core to rotate, the strand is guided to the center of the core by the bow tie. Of course, once the strand reaches the center of the bow tie, it is forced agaisnt perforations, causing the tie to be severed. Constructions without the tie shape were torn, generally at an off-center location, thus substantially diminishing the usefulness of the invention.

Generally, it will be understood that the invention may be embodied otherwise than as herein specifically illustrated or described, and that in the illustrated embodiment certain changes in the details of construction and in the form and arrangement of parts may be made without departing from the underlying idea or principles of this invention within the scope of the appended claims.

What is claimed is:

1. In combination with a coil of strand material coiled upon an annular core and having an annular surface radially spaced from and concentric with said annular core, and a pair of side surfaces extending between said annular core and said annular surface of said coil of strand material, a retention, protection, and guidance device for retaining, protecting, and guiding said strand material while said strand material is coiled upon said core and while said strand material is being uncoiled from said core, comprising:

an elongated device having a longitudinal axis;

a central portion of said elongated device being disposed upon said annular surface of said coil of strand material and extending across the width of said coil of strand material as defined between said pair of side surfaces of said coil of strand material;

longitudinally outer end portions of said device disposed upon opposite ends of said central portion of said device and folded with respect to said central portion of said device so as to engage said pair of side surfaces of said coil of strand material; and perforations defined within a substantially central region of said central portion of said device for permitting said central portion of said device to be ruptured when said strand material is being uncoiled from said core.

2. The combination as set forth in claim 1, wherein:

said device includes score line means for facilitating folding of said folded outer end portions with respect to said central portion of said elongated device.

3. The combination as set forth in claim 2, wherein:

each one of said outer end portions, as defined between said score lines and distal outer ends of said outer end portions has a substantially rectangular configuration; and said central portion of said elongated devices comprises a pair of substantially trapezoidal-configured portions defined between said perforations and said score lines.

4. The combination as set forth in claim 1, wherein:

said core is adapted to be mounted upon dispensing apparatus for permitting said strand material to be uncoiled from said core; and said folded end portions of said device, which engage and overlie said pair of side surfaces of said coil of strand material, are adapted to be interposed between said side surfaces of said coil of strand material and flanged portions of said dispensing apparatus so as to prevent said strand material, being uncoiled from said core, from becoming lodged between said side surfaces of said coil of strand material and said flanged portions of said dispensing apparatus.

5. The combination as set forth in claim 1, wherein:

said device is fabricated from corrugated fiberboard material.

6. The combination as set forth in claim 1, wherein:

said strand material comprises a product selected from the group of wire, cable, tubing, rope, and strapping material.

7. The combination as set forth in claim 1, further comprising:

tie means engaging said device and looped around said coil of strand material and said annular core for securing said device upon said coil of strand material while said strand material is stored upon said core.

8. The combination as set forth in claim 4, further comprising:

tie means engaging said device and looped around said coil of strand material and said annular core for securing said device upon said coil of strand material so as to maintain said strand material coiled upon said core when said core, and said strand material coiled thereon, is mounted upon said dispensing apparatus and prior to said strand material being uncoiled from said core.

9. In combination with a coil of strand material coiled upon an annular core and having an annular surface radially spaced from and concentric with said annular core, and a pair of side surfaces extending between said annular core and said annular surface of said coil of strand material, a plurality of retention, protection, and guidance devices for retaining, protecting, and, guiding said strand material while said strand material is coiled upon said core and while said strand material is being uncoiled from said core, each one of said devices comprising:

an elongated device having a longitudinal axis;

a central portion of said elongated device being disposed upon and overlying said annular surface of said coil of strand material and extending across the width of said coil of strand material as defined between said pair of side surfaces of said coil of strand material;

longitudinally outer end portions of said device disposed upon opposite ends of said central portion of said device and folded with respect to said central portion of said device so as to engage and overlie said pair of side surfaces of said coil of strand material; and perforations defined within a substantially central region of said central portion of said device for permitting said central portion of said device to be ruptured when said strand material is being uncoiled from said core.

10. The combination as set forth in claim 9, wherein:

said plurality of devices comprise at least two devices equiangularly disposed upon said coil of strand material.

11. The combination as set forth in claim 10, wherein:

said plurality of devices comprise three devices equiangularly disposed upon said coil of strand material.

12. The combination as set forth in claim 9, wherein:

each one of said plurality of devices includes score line means for facilitating folding of said folded outer end portions with respect to said central portion of said elongated device.

13. The combination as set forth in claim 12, wherein:

each one of said outer end portions, as defined between said score lines and distal outer ends of said outer end portions has a substantially rectangular configuration; and said central portion of each one of said plurality of devices comprises a pair of substantially trapezoidal-configured portions defined between said perforations and said score lines.

14. The combination as set forth in claim 9, wherein:

said core is adapted to be mounted upon dispensing apparatus for permitting said strand material to be uncoiled from said core; and said folded end portions of said device, which engage and overlie said pair of side surfaces of said coil of strand material, are adapted to be interposed between said side surfaces of said coil of strand material and flanged portions of said dispensing apparatus so as to prevent said strand material, being uncoiled from said core, from becoming lodged between said side surfaces of said coil of strand material and said flanged portions of said dispensing apparatus.

15. The combination as set forth in claim 9, wherein:

each one of said plurality of devices is fabricated from corrugated fiberboard material.

16. The combination as set forth in claim 9, wherein:

said strand material comprises a product selected from the group of wire, cable, tubing, rope, and strapping material.

17. The combination as set forth in claim 9, further comprising:

tie means engaging each one of said plurality of devices and looped around said coil of strand material and said annular core for securing said plurality of devices upon said coil of strand material while said strand material is stored upon said core.

18. The combination as set forth in claim 14, further comprising:

tie means engaging each one of said plurality of devices and looped around said coil of strand material and said annular core for securing said plurality of devices upon said coil of strand material so as to maintain said strand material coiled upon said core when said core, and said strand material coiled thereon, is mounted upon said dispensing apparatus and prior to said strand material being uncoiled from said core.

* * * * *